US005479249A

United States Patent [19]

Jugle et al.

[11] Patent Number: 5,479,249

[45] Date of Patent: Dec. 26, 1995

[54] BRUSH CLEANER WITH ROLL DETONING AND AIR WASTE REMOVAL

[75] Inventors: Kip L. Jugle, Holcomb; Douglas A. Lundy, Webster, both of N.Y.

[73] Assignee: Xerox Corporation, Stamford, Conn.

[21] Appl. No.: 218,922

[22] Filed: Mar. 28, 1994

[51] Int. Cl.[6] ..... G03G 21/00

[52] U.S. Cl. ..... 355/301; 355/302

[58] Field of Search ..... 355/301, 302, 355/303, 304; 15/1.51, 256.52

[56] References Cited

U.S. PATENT DOCUMENTS

| | | | |
|---|---|---|---|
| 3,917,397 | 11/1975 | Tanaka et al. | 355/302 X |
| 4,304,026 | 12/1981 | Borostyan | 355/301 X |
| 4,989,047 | 1/1991 | Jugle et al. | 355/297 |
| 5,031,000 | 7/1991 | Pozniakas et al. | 355/297 |
| 5,381,218 | 1/1995 | Lundy | 355/302 X |

OTHER PUBLICATIONS

*IBM Tech. Disclosure Bulletin;* vol. 19, No. 3, Aug. 1976, Boman, et al., "Cleaning Station for an Electrographic Copying Machine", pp. 808–809.

*Primary Examiner*—Joan H. Pendegrass
*Attorney, Agent, or Firm*—T. L. Fair

[57] ABSTRACT

A cleaning apparatus that comprises a brush cleaner to remove particles from the imaging surface. The particles are removed from the brush cleaner using a detoning roll. The particles are loosened and separated from the detoning roll using a scraper blade. These loosened and separated particles, from the detoning device, are carried to a waste container by an air stream alone rather than using an augering system.

16 Claims, 3 Drawing Sheets

BRUSH CLEANER WITH ROLL DETONING AND AIR WASTE REMOVAL

CROSS-REFERENCE TO RELATED APPLICATION

This application is related to the commonly-assigned, U.S. application Ser. No. 08/155,321, filed Nov. 11, 1993, in the name of Douglas A. Lundy, now U.S. Pat. No. 5,381,218.

BACKGROUND OF THE INVENTION

This invention relates generally to an electrostatographic printer or copier, and more particularly concerns a cleaning apparatus having an air removal system for waste removed from a brush detoning roll.

In an electrophotographic application such as xerography, a charge retentive surface (i.e., photoconductor, photoreceptor or imaging surface) is electrostatically charged, and exposed to a light pattern of an original image to be reproduced to selectively discharge the surface in accordance therewith. The resulting pattern of charged and discharged areas on that surface from an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (eg., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charge surface may be imagewise discharged in a variety of ways. Ion projection devices where a charge is imagewise deposited on a charge retentive substrate operates similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a brush with soft conductive fiber bristles or with insulative soft bristles which have suitable triboelectric characteristics. While the bristles are soft for the insulative brush, they provide sufficient mechanical force to dislodge residual toner particles from the charge retentive surface. In the case of the conductive brush, the brush is usually electrically biased to provide an electrostatic force for toner detachment from the charge retentive surface.

After cleaning the charge retentive surface (i.e. imaging surface), a common method of cleaning the brush fibers is by utilizing a detoning roll. Currently the biggest problem associated with roll detoning is the reliability of the augering system used to remove the toner from the biased detone rolls. The heat generated by the augers blocks the toner and the technical representative often has to completely replace the cleaner assembly.

The following disclosure may be relevant to various aspects of the present invention and may be briefly summarized as follows:

U.S. Pat. No. 4,989,047 to Jugle et al. discloses the removal of debris and toner removal from the cleaning housing is by an auger arrangement which respectively moves debris to a storage area for subsequent removal and toner to the developer station for reuse. Additionally, there is an air stream for toner and debris removal.

U.S. Pat. No. 5,031,000 to Pozniakas et al. discloses the removal of debris and toner removal from the cleaning housing is by an auger arrangement which respectively moves debris to a storage area for subsequent removal and toner to the developer station for reuse. Additionally, there is an air stream for toner and debris removal.

SUMMARY OF INVENTION

Briefly stated, and in accordance with one aspect of the present invention, there is provided an apparatus for cleaning particles from a surface, comprising: a housing, defining an open ended chamber, a brush mounted in the chamber of the housing, the brush including a multiplicity of fibers contacting the surface for removal of particles therefrom; a detoning device, operatively associated with the brush, to remove the particles therefrom to ensure sufficient cleaning of said brush; a removal device, adjacent to the detoning device, for separating particles from the detoning, for a first air channel positioned adjacent to the detoning device; a second air channel positioned adjacent the removal device opposed from the first air channel; and means for generating a flow of air through the first air channel and the second air channel to transport particles removed from the detoning device away from the detoning device.

Pursuant to another aspect of the present invention, there is provided a printing machine of the type having a cleaning apparatus for removing particles from an imaging surface, comprising: a housing, defining an open ended chamber, a brush mounted in the chamber of the housing, the brush including a multiplicity of fibers contacting the surface for removal of particles therefrom; a detoning device, operatively associated with the brush, to remove the particles therefrom to ensure sufficient cleaning of said brush; a removal device, adjacent to the detoning device, for separating particles from the detoning device, for a first air channel positioned adjacent to the detoning device; a second air channel positioned adjacent the removal device opposed from the first air channel; and means for generating a flow of air through the first air channel and the second air channel to transport particles removed from the detoning device away from the detoning device.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 3:
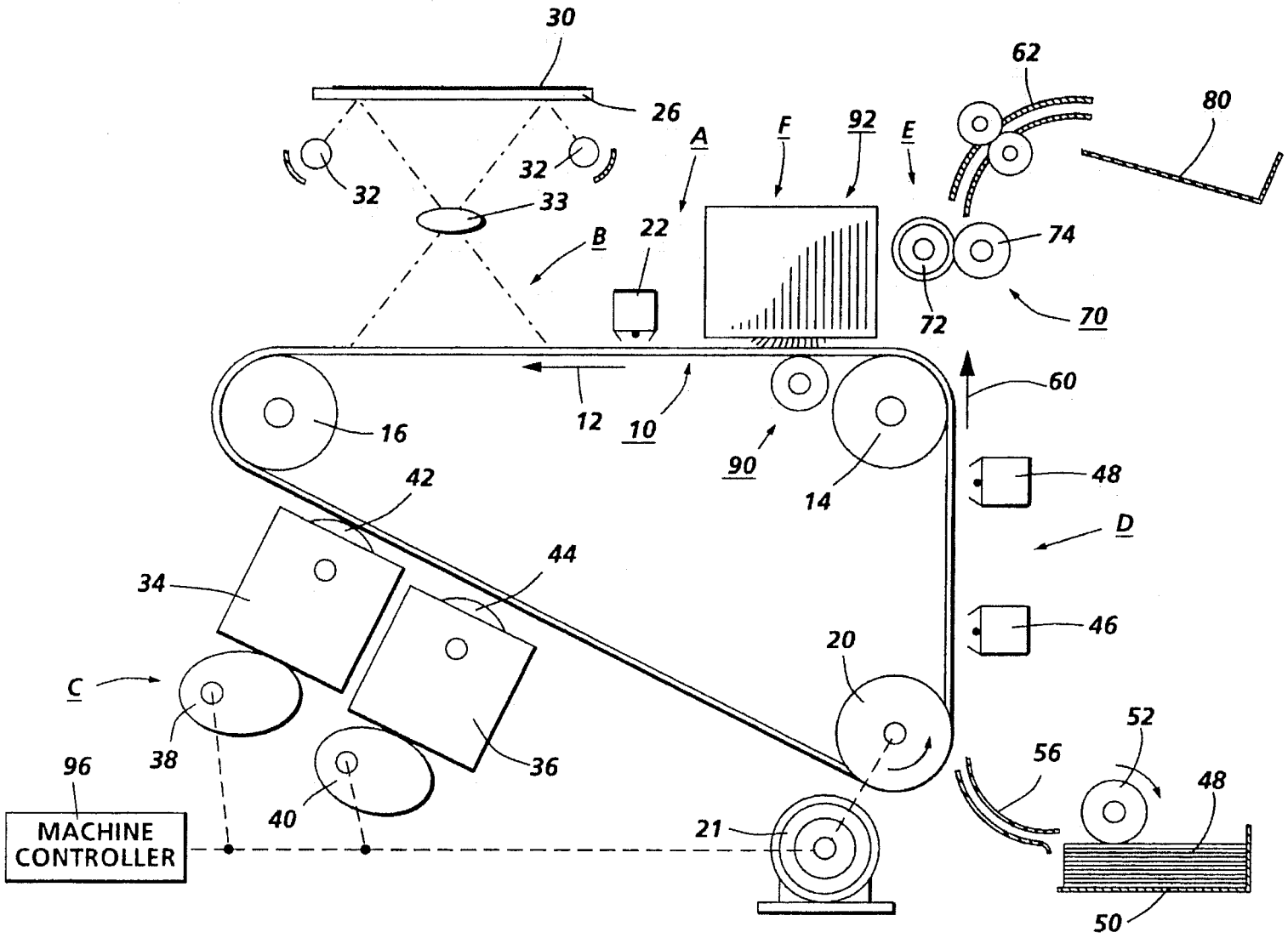
FIG. 3 is a schematic illustration of a printing apparatus incorporating the inventive features of the present invention.

For a general understanding of an electrophotographic printer or copier in which the present invention may be incorporated, reference is made to FIG. 3, which depicts schematically the various components, thereof. Hereinafter, like reference numerals will be employed throughout to designate identical elements. Although the flexible conductive cleaner brush apparatus of the present invention is particularly well adapted for use in an electrophotographic printing machine, it should become evident from the following discussion, that it is equally well suited for use in other applications and is not necessarily limited to the particular embodiment shown herein.

Referring now to the drawings, the various processing stations employed in the reproduction machine illustrated in FIG. 3, will be described briefly hereinafter. It will no doubt be appreciated that the various processing elements also find advantageous use in electrophotographic printing applications from an electronically stored original, and with appropriate modifications, to an ion which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance excessive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 3, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to develop station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60 to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The cleaning apparatus of the present invention is represented by the reference numeral 92 which will be described in greater detail in FIG. 2. Removed residual particles may also be stored for disposal. A backup roll 90 is provided as support to the photoreceptor belt 10 during the cleaning phase of the xerographic process.

A machine controller 96 is preferably a known programmable controller or combination of controllers, which conventionally control all the machine steps and functions described above. The controller 96 is responsive to a variety of sensing devices to enhance control of the machine, and also provides connection diagnostic operations to a user interface (not shown) where required.

As thus described, a reproduction machine, in accordance with the present invention may be any of several well known devices. Variations may be expected in specific electrophotographic processing, paper handling and control arrangements without effecting the present invention. However, it is believed that the foregoing description is sufficient for purposes of the present application to illustrate the general operation of an electrophotographic printing machine which exemplifies one type of apparatus employing the present invention therein.

Figure 1:
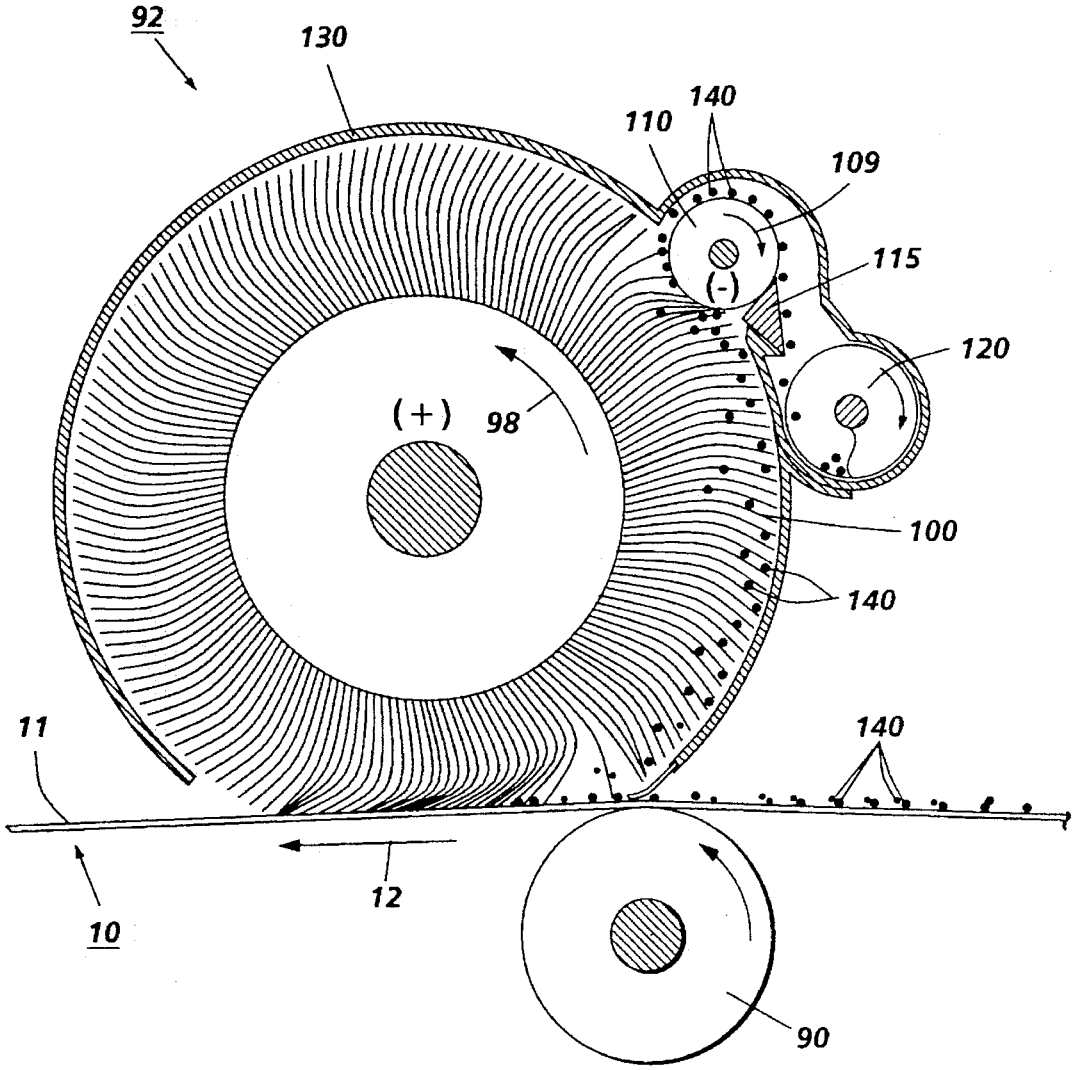
PRIOR ART FIG. 1
FIG. 1 is an elevational view of prior art using an auger waste removal system.

Reference is now made to FIG. 1, which shows an elevational view of the prior art using an auger waste removal system for the detoning roll. An electrostatic brush 100, rotating in the direction of arrow 98, inside a housing 130, cleans the imaging surface 11 of the photoreceptor 10. The residual particles 140 (i.e. toner particles and other debris) removed from the imaging surface 11 are cleaned from the brush fibers by a detoning roll 110. The detoning roll 110, rotating in the direction of arrow 109, attracts the charged particles 140 from the electrostatic brush fibers. A scraping blade 115 contacts the surface of the detoning roll 110 removing the residual particles 140 therefrom. The scraping blade 115 is positioned relative to the detoning roll 110 and the auger 120 such that the residual particles 140 removed by the blade 115 from the detoning roll surface, cascade over the blade surface down into the auger 120. The auger 120, rotating in the direction of arrow 119, transports the residual particles 140 to a waste toner container (not shown). The rotation of the auger 120 generates heat. This heat causes the toner particles to become soft, "blocking" the auger's rotation creating an unreliable waste removal system. (This "blocking" often causes a breakdown of the augering system.)

Figure 2:
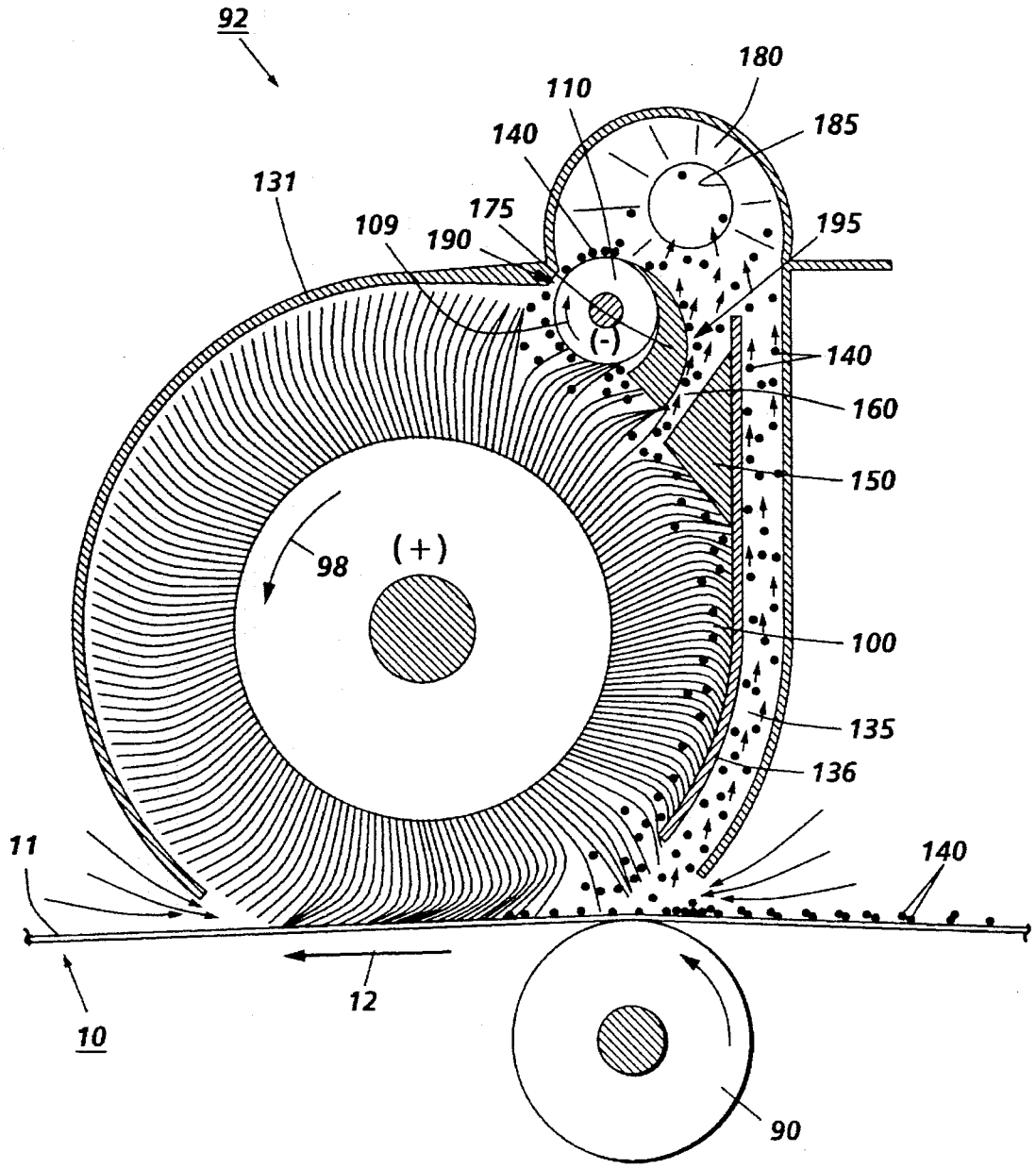
FIG. 2 is an elevational view of the present invention using an air waste removal system for the detoning roll.

Reference is now made to FIG. 2, which shows an elevational view of a brush cleaner with the present invention of an air waste removal system for the detoning roll. The present invention uses an electrically biased detone roll 110 for detoning a brush cleaner 100 and then uses air, to transport the waste removed from the detone roll 110, rather than an augering system.

With continued reference to FIG. 2, the cleaning system has a rotating electrostatic brush 100 with brush fibers extending radially from a center core. The rotating brush fibers contact the photoreceptor 10, causing a flicking action as the fibers leave the photoreceptor 10 that releases particles 140 therein, creating a powder cloud. A powder cloud vacuum port allows air flow, created by a vacuum 185, to enter the brush housing 131. The particles 140 released from the fibers are carried away by the air flow to the waste toner exhaust chamber 180 by an air channel 135 in the housing. This channel 135 is separated from the remainder of the housing by a dividing wall 136 containing the rotating brush 100.

With continued reference to FIG. 2, the brush fibers rebound from contact with the flicker bar 150 (i.e. mechanical detoning), creating a moving node affect releasing loosely held particles from the fibers into the air stream. This nodal affect allows air to move the residual particles 140 released from the fibers away from the brush fibers toward the waste toner chamber 180, where the particles 140 are then sent to a waste toner bottle (not shown). Adjacent to the flicker bar 150 is a vacuum throat 160 that the air flow entrained with toner and other waste particles (i.e. Kaolin, paper, debris, etc.) passes through to the waste toner exhaust chamber 180. A biased detone roll 110, rotating in the clockwise direction indicated by arrow 109, further cleans the brush fibers rebounding from contact with the flicker bar 150. The biased detone roll 110 attracts toner particles 140 electrostatically held from the brush fibers onto the detoning roll surface. A detone roll scraper 175 (e.g. stainless steel blade) is used to remove the toner particles from the biased detone roll surface. The scraper 175 contacts the detone roll surface using a chiseling action to remove the residual particles from the detoning surface. On opposite sides of the detoning roll 110 are air channels 190, 195 to carry the dislodged toner particles 140 toward the waste toner exhaust chamber 180 by the air flow, created by a vacuum 185. The waste particles are later deposited into a waste container (not shown).

The air channels 190, 195 are openings on either side of the detone roll 110. The detone roll scraper 175 is designed to also create a baffle. Only the scraper portion of the scraper/baffle is in contact with the detoner roll 110. One air channel 195 is formed between the scraper/baffle 175 and the flicker bar 150. The other air channel 190 is formed between the arcuate surface of the detoning roll 110 and the inside surface of the housing wall. The brush fibers release any remaining particles 140 as the brush fibers are released from contact with the rotating biased detone roll 110. The particles chiseled from the detone roll surface cascade into the air flow (i.e. air stream) that passes through air channel 195. The particles remaining in the brush fibers, after passing the detoning roll 110, are mechanically flicked from the detoning roll 110 into the air channel 190. The airflow created by the vacuum through these air channels 190, 195 carry the particles to the waste toner exhaust chamber 180. The air assist for the detoning roll, of the present invention, removes the need for an augering system, which simplifies the cleaner configuration but, also helps keep the xerographic cavity cooler with the air flow. The air also aids in keeping the dirt levels lower since the cleaner is under a negative pressure and toner is not allowed to powder cloud and leave the cleaner.

In recapitulation, the present invention provides an air waste removal system to remove particles removed from the detoning roll. The toner is scraped from the detone rolls using a blade that allows the toner and waste particles to cascade into the air streams created by the air channels (or ports) on either side of the detone roll. The air waste removal system eliminates the augering system and it's unreliability. Also with the use of air system instead of an auger the xerographic cavity is cooler.

It is, therefore, apparent that there has been provided in accordance with the present invention, an air waste removal system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a surface, comprising:

a housing defining an open ended chamber;

a brush, mounted in the chamber of said housing, including a multiplicity of fibers contacting the surface for removal of particles therefrom;

a detoning device, operatively associated with said brush, to remove the particles therefrom to ensure sufficient cleaning of said brush;

a removal device, adjacent said detoning device, for separating particles from said detoning device; and a first air channel positioned adjacent said detoning device, said first air channel comprising a baffle, having a concave side and a convex side partially enclosing said detoning device and said removal device;

a second air channel positioned adjacent said removal device opposed from said first air channel; and means for generating a flow of air through said first air channel and said second air channel to transport particles removed from said detoning device away from said detoning device.

2. An apparatus as recited in claim 1, wherein said removal device comprises a blade including a blade contacting said detoning device.

3. An apparatus as recited in claim 2, wherein said edge scrapes the particles from said detoning device into said air streams.

4. An apparatus as recited in claim 3, wherein said first air channel further comprises:

a flicker bar; and a first opening between said convex side of said baffle and said flicker bar through which air passes entrained with particles removed from said detoning device.

5. An apparatus as recited in claim 4, wherein said second air channel comprises a second opening between said detoning device and an inner wall of said housing.

6. An apparatus as recited in claim 5, wherein said detoning device comprises a roll.

7. An apparatus as recited in claim 6, wherein said detoning device comprises means for electrically biasing said roll.

8. An apparatus as recited in claim 7, further comprising a third channel, said third channel being a third opening positioned between a dividing wall and an outer wall of said housing, said dividing wall, separating said brush from said third opening, and air flow, created by said generating means, passes through said third channel entrained with particles removed from said brush.

9. A printing machine of the type having a cleaning apparatus for removing particles from an imaging surface, comprising:

a housing defining an open ended chamber;

a brush, mounted in the chamber of said housing, including a multiplicity of fibers contacting the surface for removal of particles therefrom;

a detoning device operatively associated with said brush, to remove the particles therefrom to ensure sufficient cleaning of said brush;

a removal device, adjacent said detoning device, for separating particles from said detoning device; and a first channel positioned adjacent said detoning device, said first air channel comprising a baffle, having a concave side and a convex side opposite one another, said concave side partially enclosing said detoning device and said blade;

a second air channel positioned adjacent said removal device opposed from said first air channel; and means for generating a flow of air through said first air channel and said second air channel to transport particles removed from said detoning device away from said detoning device.

10. A printing machine as recited in claim 9, wherein said removal device comprises a blade including a blade contacting said detoning device.

11. A printing machine as recited in claim 10, wherein said edge scrapes the particles from said detoning device into said air streams.

12. A printing machine as recited in claim 11, wherein said first air channel further comprises:

a flicker bar; and a first opening between said convex side of said baffle and said flicker bar through which air passes entrained with particles removed from said detoning device.

13. A printing machine as recited in claim 12, wherein said second air channel comprises a second opening between said detoning device and said inner wall of said housing.

14. A printing machine as recited in claim 13, wherein said detoning device comprises a roll.

15. A printing machine as recited in claim 14, wherein said detoning device comprises means for electrically biasing said roll.

16. A printing machine as recited in claim 15, further comprising a third channel, said third channel being a third opening positioned between a dividing wall and an outer wall of said housing, said dividing wall, separating said brush from said third opening, and air flow, created by said generating means, passes through said third channel entrained with particles removed from said brush.

* * * * *